United States Patent [19]

Castilano

[11] Patent Number: 4,549,723

[45] Date of Patent: Oct. 29, 1985

[54] CABLE BLOCK DEVICE

[75] Inventor: Charles R. Castilano, Dayton, Ohio

[73] Assignee: Jackson Enterprises, Clayton, Ohio

[21] Appl. No.: 629,887

[22] Filed: Jul. 11, 1984

[51] Int. Cl.[4] ..... B66D 3/04

[52] U.S. Cl. ..... 254/405; 254/134.3 PA; 254/411

[58] Field of Search ..... 254/405, 409, 411, 402, 254/403, 134.3 PA

[56] References Cited

U.S. PATENT DOCUMENTS

| | | | |
|---|---|---|---|
| 856,335 | 6/1907 | Callahan | 254/409 |
| 1,061,895 | 5/1913 | Bierce | 254/405 |
| 2,786,092 | 3/1957 | Gage | 254/134.3 |
| 2,980,401 | 4/1961 | Witmor | 254/134.3 PA |
| 3,095,471 | 6/1963 | Price . | |
| 3,098,638 | 7/1963 | McAuley . | |
| 3,146,994 | 9/1964 | Sherman | 254/134.3 |
| 3,199,841 | 8/1965 | McKean | 254/411 X |
| 3,819,154 | 6/1974 | Miller | 254/134.3 PA |
| 3,834,674 | 9/1974 | Jackson | 254/394 |
| 3,853,304 | 12/1974 | Jackson | 254/134.3 PA X |

*Primary Examiner*—Stuart S. Levy

*Assistant Examiner*—Katherine Jaekel

*Attorney, Agent, or Firm*—Jacox & Meckstroth

[57] ABSTRACT

A cable block device which is capable of clamping upon a strand of any conventional diameter and which is capable of retaining a cable or cables of any conventional diameter. The cable block device includes a bracket which hooks over a strand to support the bracket. A shaft which extends through the bracket has a lever attached thereto. A cam is also attached to the shaft. The lever, the shaft, and the cam rotate together. A portion of the cam is engageable with the strand which supports the bracket to establish clamping action of the cam upon the strand. A roller is also attached to the bracket and is rotatable with respect to the bracket to support a portion of a continuous cable or cables.

An arm is attached to the cam for pivotal movement of the arm with rotative movement of the cam. The arm extends from the cam and has a retainer portion. The retainer portion of the arm is movable to a position spaced from the roller, to permit positioning a portion of a cable upon the roller. The retainer portion of the arm is also movable to a position closely adjacent the roller to prevent escape of the cable from the roller.

15 Claims, 15 Drawing Figures

CABLE BLOCK DEVICE

BACKGROUND OF THE INVENTION

An aerial block or cable block is conventionally employed in the process of attaching a cable or cables to a support strand. The aerial block or cable block conventionally comprises a support bracket which is adapted to be placed upon a support strand for support thereby. The bracket has one or more rollers or sheaves rotatably attached thereto. The rollers or sheaves support a cable or cables which are placed thereupon as the cable or cables are strung along the strand. Means are provided to clamp the support bracket to the support strand.

One of the problems which has existed in regard to such cable blocks is that some cables are of such a small diameter or of such other characteristics that the cable has a tendency to escape from the support roller or sheave.

Another problem exists in that the support strand may be of a large diameter or a small diameter or any intermediate diameter.

It is an object of this invention to provide cable block structure which prevents a cable from removal or escape from the cable support roller.

Another object of this invention is to provide such cable block structure which is operable to clamp the support bracket to the support strand regardless of the diameter of the support strand and simultaneously function to prevent escape of a cable from the cable support roller.

Other objects and advantages of this invention reside in the construction of parts, the combination thereof, the method of production and the mode of operation, as will become more apparent from the following description.

SUMMARY OF THE INVENTION

This invention comprises a cable block device which includes a support bracket adapted to be supported by a support strand. A roller or sheave is rotatably supported by the bracket. A clamping member is operable to clamp the support bracket to the support strand. A retainer member is operable with operation of the clamping member to retain a cable upon the roller or sheave.

DETAILED DESCRIPTION OF THE PREFERRED EMBODIMENT OF THE INVENTION

Figure 1:
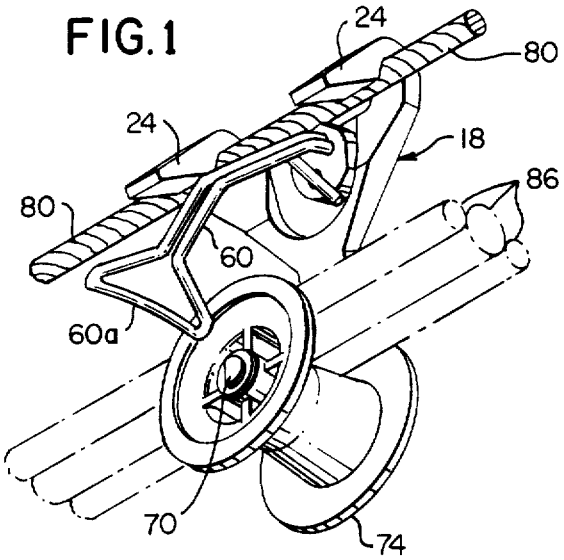
FIG. 1 is a bottom perspective view of a cable block device of this invention, illustrating the cable block device attached to a support strand for support thereby. This view also illustrates a plurality of cables supported by the cable block device.
Figure 2:
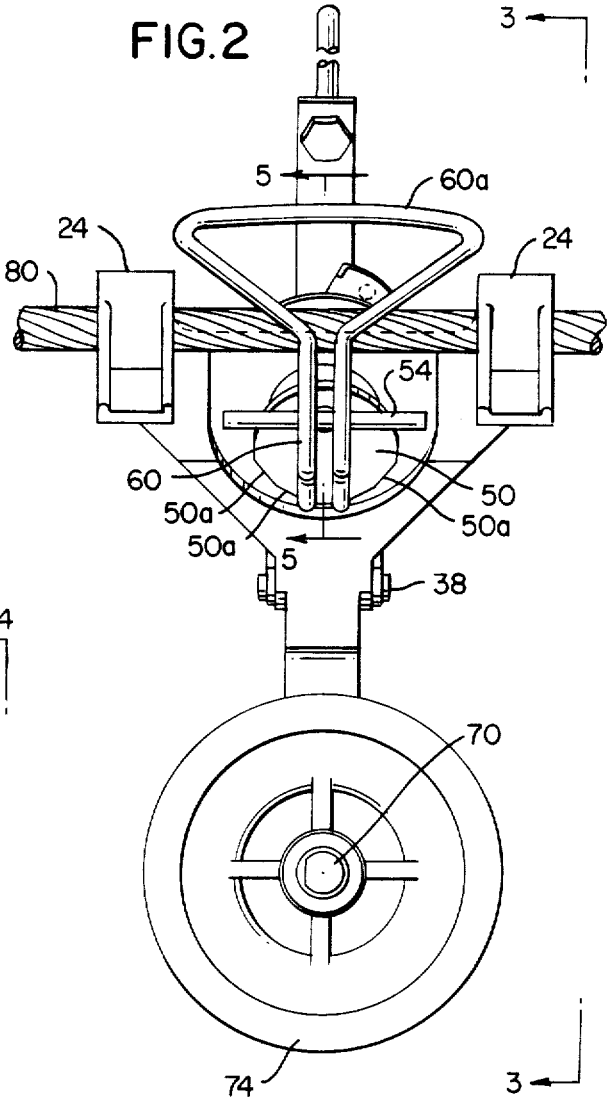
FIG. 2 is a side elevational view, drawn on a larger scale than FIG. 1, showing the cable block device of FIG. 1 supported by a support strand prior to placing a cable upon the roller of the device and prior to clamping the bracket to the strand.
Figure 3:
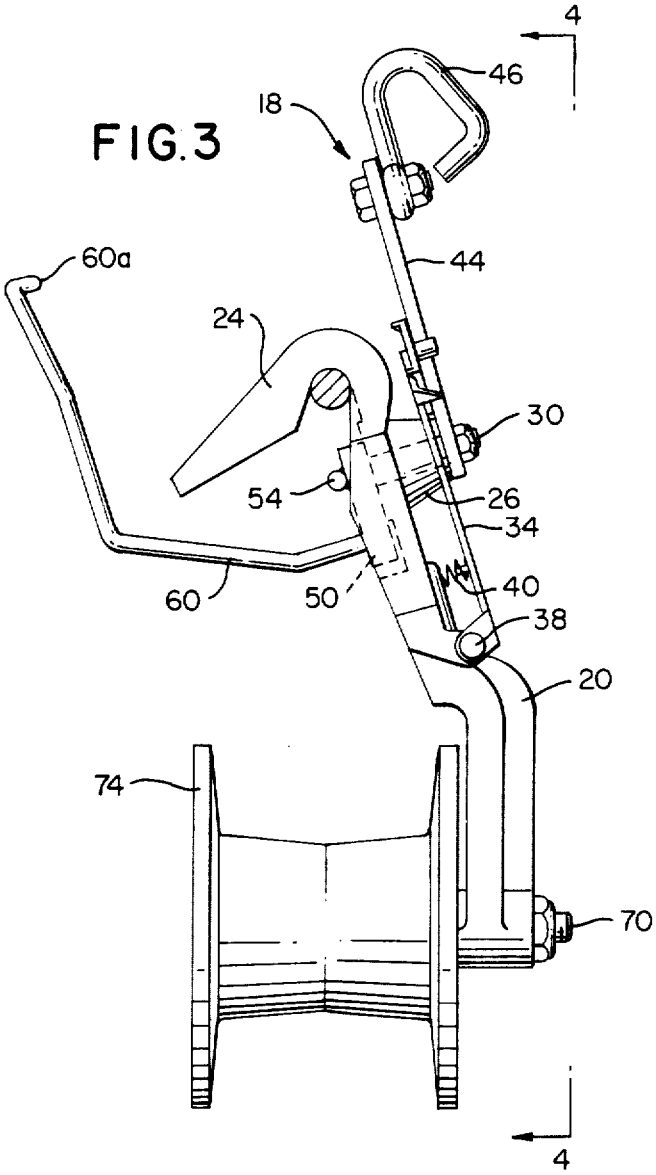
FIG. 3 is a sectional view taken substantially on line 3—3 of FIG. 2.
Figure 4:
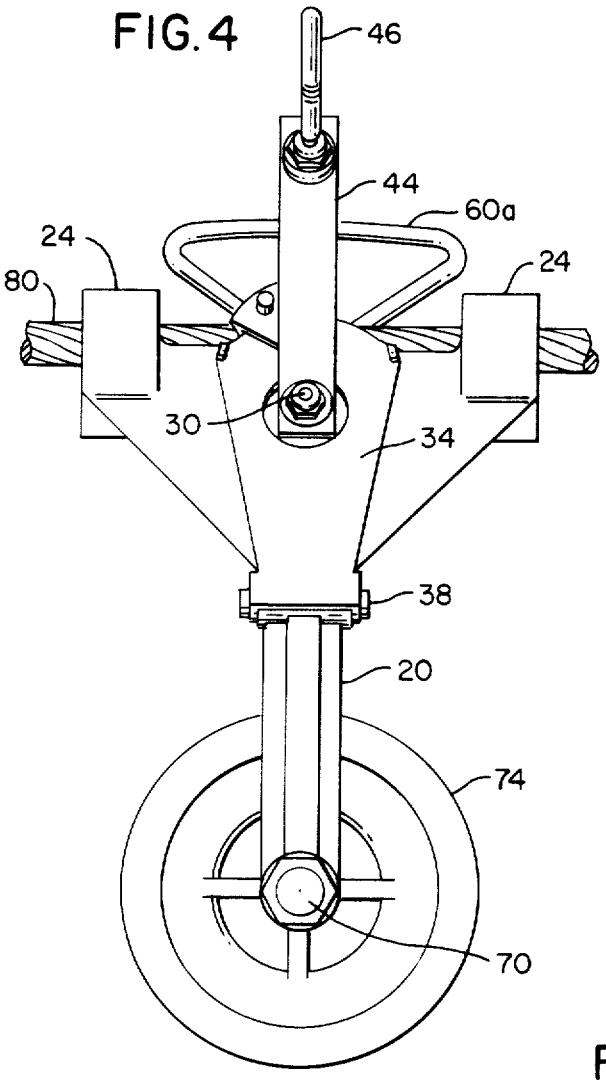
FIG. 4 is a side elevational view taken substantially on line 4—4 of FIG. 3.
Figure 5:
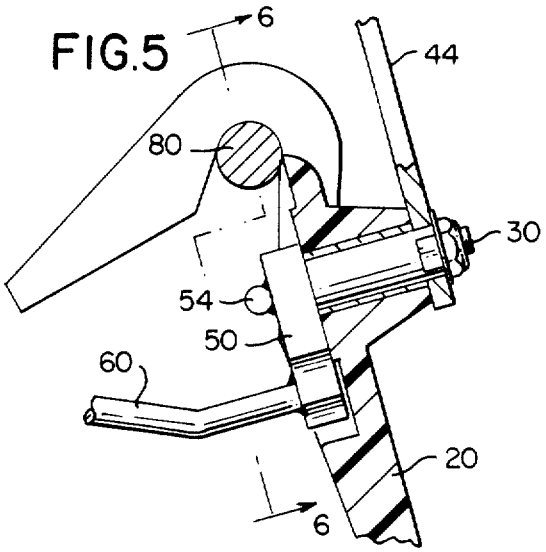
FIG. 5 is a fragmentary sectional view taken substantially on line 5—5 of FIG. 2, drawn on a slightly larger scale than FIG. 2.
Figure 6:
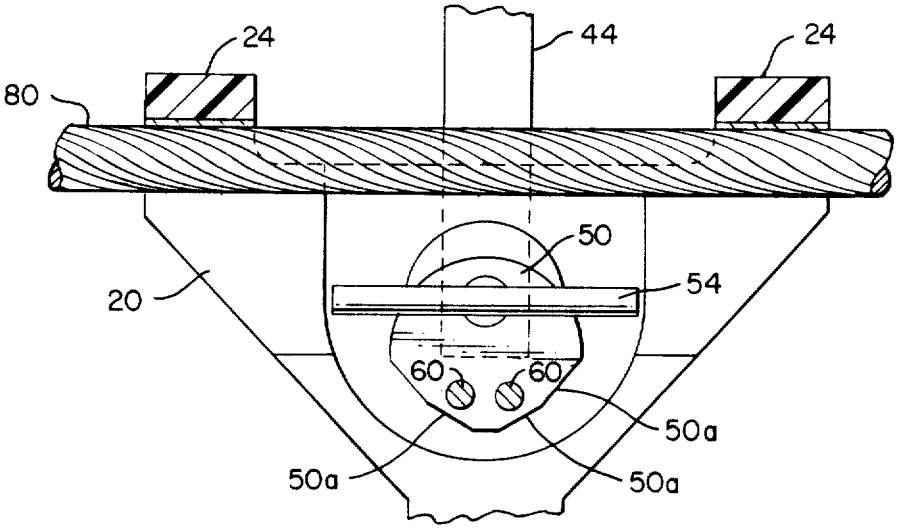
FIG. 6 is a fragmentary sectional view, taken substantially on line 6—6 of FIG. 5.

A cable block 18 of this invention comprises a bracket 20, which is provided with hooks 24 at the upper portion thereof. The bracket 20 has a protuberance 26 through which a shaft 30 extends. A plate 34 loosely encompasses the protuberance 26 and is attached to the bracket 20 by means of a pin 38. The plate 34 is pivotal about the pin 38. A spring 40 engages the plate 34 and the bracket 20 and urges the plate 34 outwardly from the bracket 20. A lever 44 is attached to the shaft 30 for rotation of the shaft 20. The lever 44 has a loop 46 pivotally attached to the end thereof.

The shaft 30 also has a cam member 50 attached thereto for rotation with the shaft 30. The cam member 50 has a plurality of angular arranged engagement portions **50*a*** at the periphery thereof.

Attached to the cam member 50 and extending substantially at right angles to the shaft 30 is a stem 54. Also attached to the cam member 50 and extending angularly therefrom is an arm 60, which has a curved retainer end portion **60*a***.

The retainer end portion **60*a* is shown as being substantially normal to the main portion of the arm 60. The retainer end portion 60*a* also extends laterally with respect to the main portion of the arm 60 in a plane substantially normal to the main portion of the arm 60. The arm 60 is shown as consisting of heavy wire material or the like. However, of course, the arm 60** may be formed from any suitable material.

A shaft 70 extends through the bracket 20 at the lower portion thereof and rotatably supports a roller or sheave 74.

OPERATION

The loop 46 at the end of the lever 44 is adapted to be engaged for lifting the cable block 18 to a position adjacent a support strand 80, shown in FIGS. 2-10. The hooks 24 are hooked over the strand 80, as illustrated in FIGS. 2–6. As the cable block 18 is initially positioned and supported upon the strand 80, the lever 44 extends upwardly. Thus, the arm 60 extends upwardly, as illustrated in FIGS. 2–6.

Figure 7:
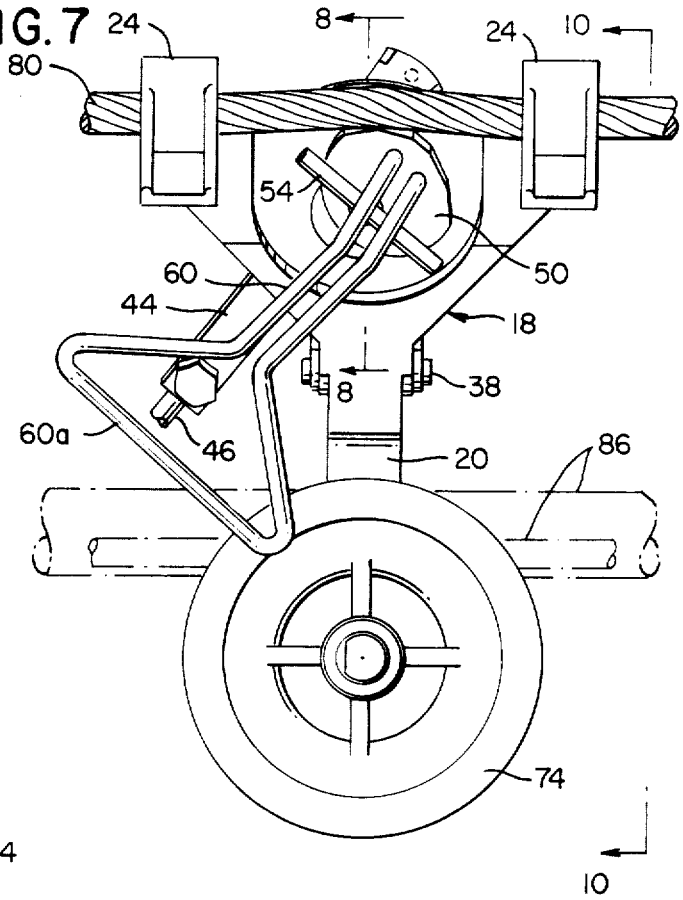
FIG. 7 is a side elevational view, similar to FIG. 2, but showing the cable block device adjusted in clamped condition to retain the device in fixed position with respect to the support strand, and showing the cable block device adjusted to retain a cable in position upon the roller of the cable block device.
Figure 8:
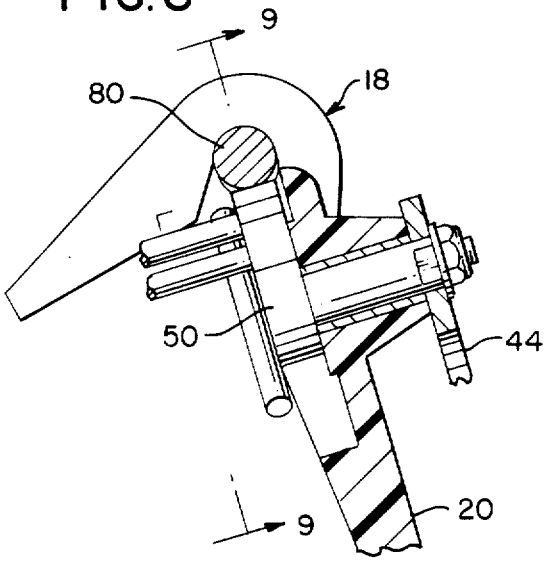
FIG. 8 is a fragmentary sectional view taken substantially on line 8—8 of FIG. 7 and drawn on a slightly larger scale than FIG. 7.
Figure 9:
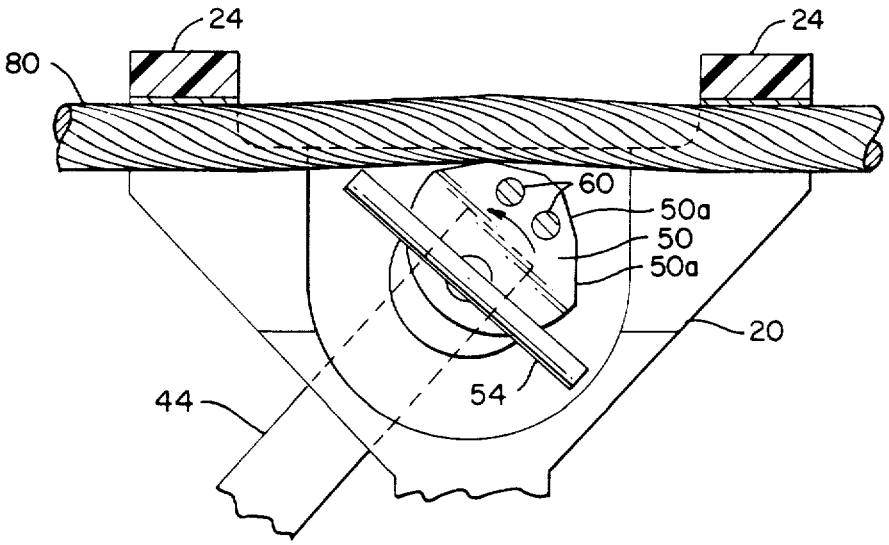
FIG. 9 is a sectional view taken substantially on line 9—9 of FIG. 8.
Figure 10:
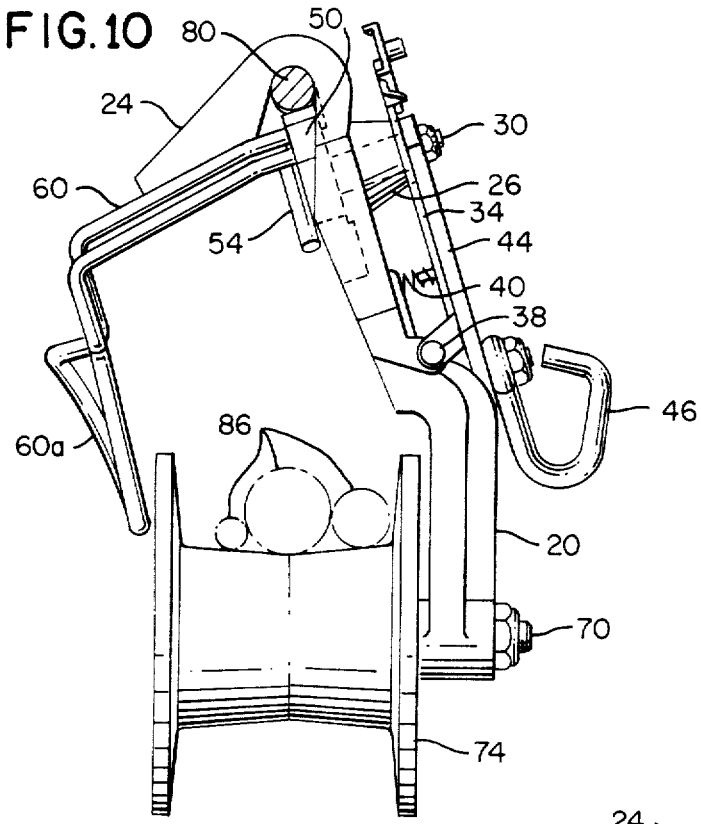
FIG. 10 is a sectional view taken substantially on line 10—10 of FIG. 7.
Figure 11:
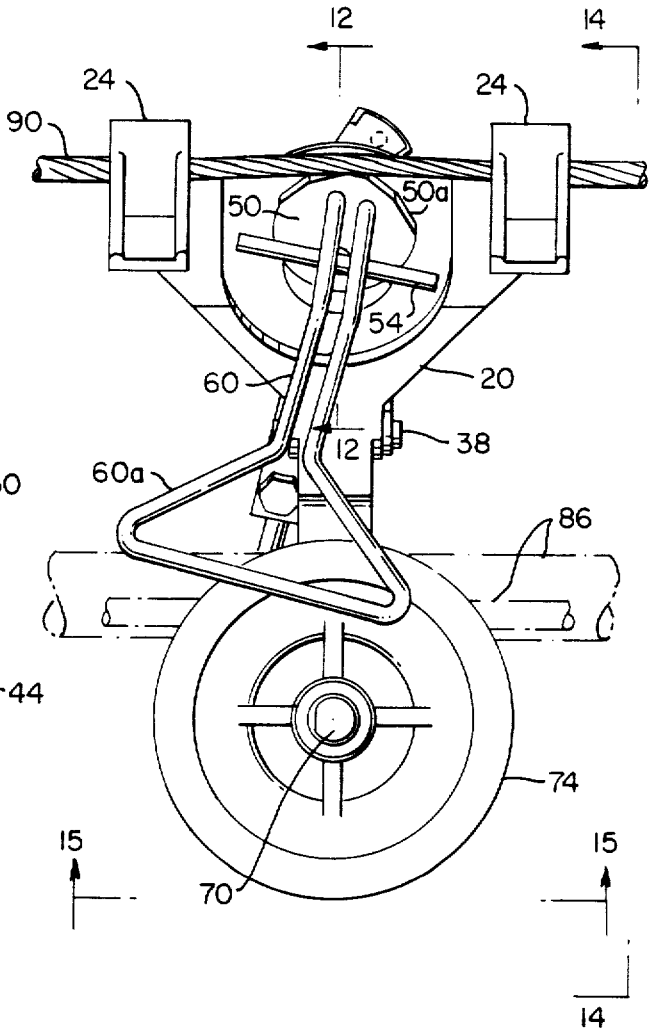
FIG. 11 is a side elevational view similar to FIG. 7 illustrating the cable block device clamped to a strand which is smaller in diameter than the strand to which the device is clamped in FIG. 7.
Figure 12:
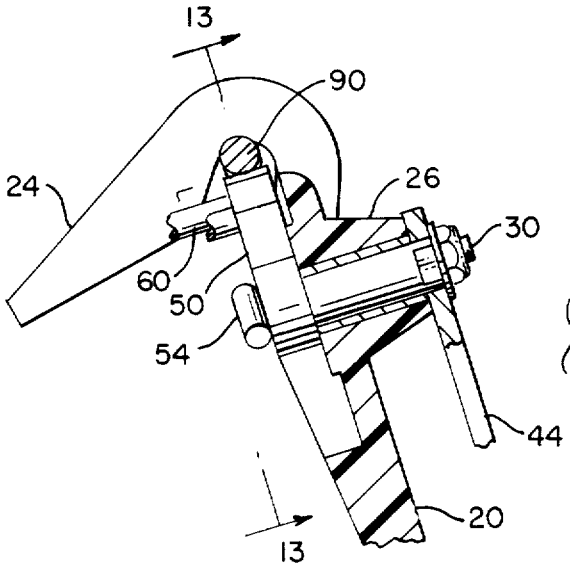
FIG. 12 is a fragmentary sectional view taken substantially on line 12—12 of FIG. 11, and drawn on a slightly larger scale than FIG. 11.
Figure 13:
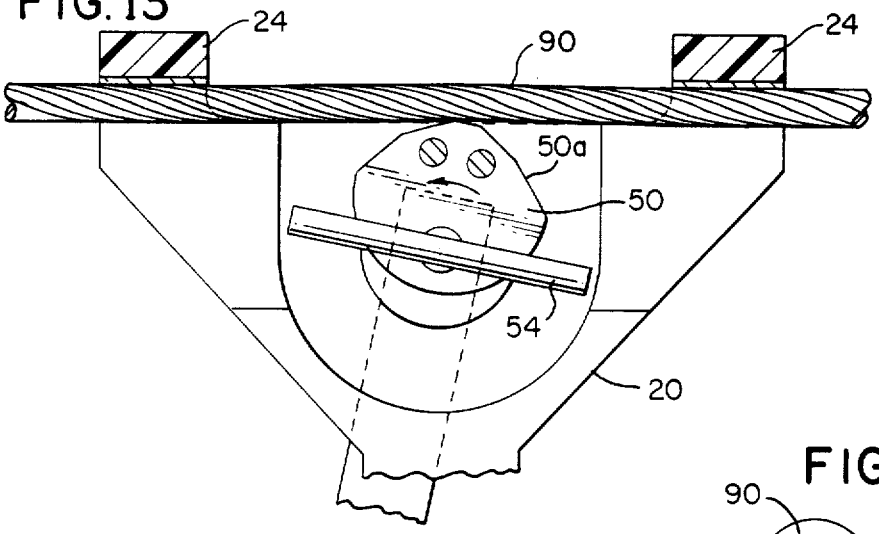
FIG. 13 is a sectional view taken substantially on line 13—13 of FIG. 12.
Figure 14:
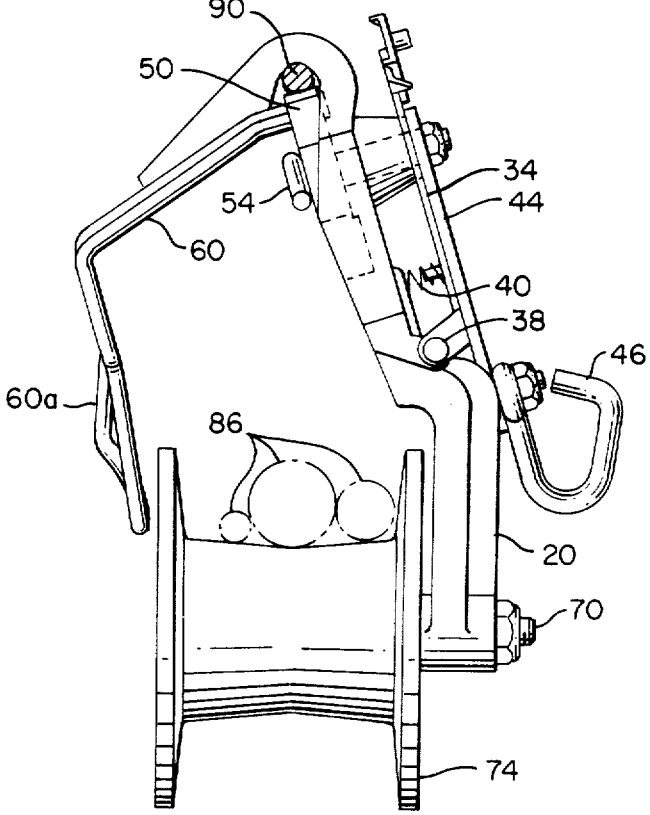
FIG. 14 is a sectional view taken substantially on line 14—14 of FIG. 11.
Figure 15:
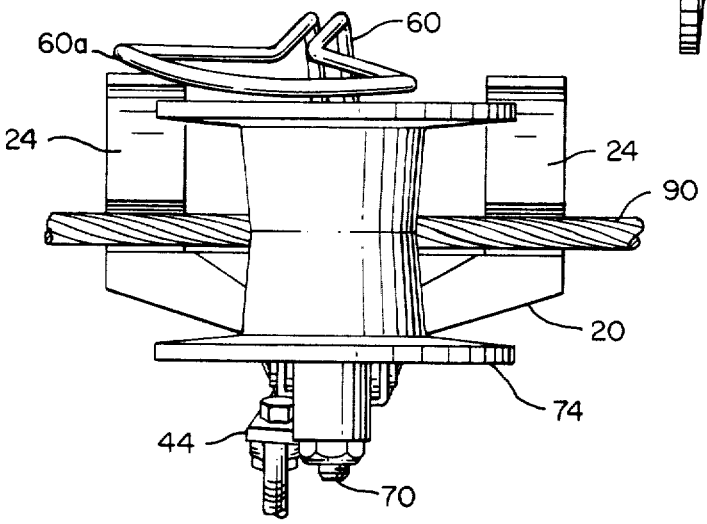
FIG. 15 is a bottom plan view taken substantially on line 15—15 of FIG. 14.

Then, as the lever 44 and the arm 60 extend upwardly, a cable or cables 86 are placed upon the sheave 74, as illustrated in FIGS. 7 and 10. Then the lever 44 is angularly moved downwardly. Angular downward movement of the lever 44 rotates the shaft 30 and rotates the arm 60 downwardly. Rotation of the shaft 30 also rotates the cam member 50. The lever 44 is angularly moved until a part of the cam member 50 engages the strand 80. When this engagement occurs, the cam member 50 forces the strand 80 against the hooks 24, and the bracket 20 is thus secured to the strand 80, as best shown in FIG. 9. The angle through which the lever 44 is rotated before the cam member 50 clamps the bracket 20 to the strand 80 depends upon the diameter or cross sectional dimension of the strand 80. If the strand 80 has a relatively large diameter, as illustrated in FIGS. 2–10, the lever 44 and the cam member 50 can be rotated through a relatively small angle before an engagement portion 50*a* of the cam member 50 engages the strand 80, as illustrated in FIGS. 7, 9, and 10. When the cam member 50 thus clamps the strand 80 to the bracket 20, the arm 60 is positioned so that at least a part of the retainer end portion 60*a* is positioned closely adjacent the roller or sheave 74, as best shown in FIGS. 7 and 10. Thus, as the bracket 20 is clamped to the strand 80, the retainer end portion 60*a* of the arm 60 prevents escape of the cable or cables 86 from the sheave 74, as illustrated in FIGS. 7 and 10.

FIGS. 11–15 show the cable block 18 of this invention supported by a strand 90 which is considerably smaller in diameter than the diameter of the strand 80. Therefore, the lever 44 and the cam member 50 are pivotally moved a greater degree from the vertical position of the lever 44 until a portion of the cam member 50 engages the strand 90, as illustrated in FIGS. 11–15. Due to the fact that the arm 60 is attached to the cam member 50, the arm 60 is moved through a greater angle when the bracket 20 is clamped upon the strand 90. Even though the arm 60 angularly moves through a greater angle, the retainer end portion 60*a* has at least a part thereof closely adjacent the sheave 74 and prevents a cable 86, of any diameter, positioned upon the roller 74 from escape from the sheave 74.

Therefore, it is understood that the cable block 18 of this invention is capable of retaining a cable of any diameter upon the roller or sheave 74 when the cable block 18 is clamped to a strand of any diameter. The retainer end portion 60*a* covers a sufficient area and has a proper curvature so that at any clamping angle of the cam member 50, at least a part of the retainer end portion 60*a* of the arm 60 is closely adjacent the sheave 74.

Although the preferred embodiment of the cable block device of this invention has been described, it will be understood that within the purview of this invention various changes may be made in the form, details, proportion and arrangement of parts, the combination thereof, and the mode of operation, and means of use which generally stated consist in a cable block device within the scope of the appended claims.

The invention having thus been described, the following is claimed:

1. A cable block device for attachment to a support strand and adapted to support a cable comprising:

a bracket provided with a support element for engagement with a support strand for support of the bracket upon the support strand, a rotary shaft supported by the bracket, a lever attached to the shaft for rotation thereof, a cam attached to the shaft for rotation therewith, the cam being provided with an engagement surface for engagement of the cam with a support strand with which the support element is in engagement, the cam forcing the strand against the support element for clamping the bracket to the strand, a roller rotatively attached to the bracket, an arm provided with a main portion which extends angularly from the cam and which moves angularly with rotative movement of the lever and the cam, the arm being provided with a retainer portion which extends laterally and substantially at right angles with respect to the main portion of the arm, the retainer portion of the arm being movable with angular movement of the arm to a position spaced from the roller for receipt of a cable upon the roller, the retainer portion of the arm being movable with angular movement of the arm to a position adjacent the roller to prevent escape of a cable from the roller, the retainer portion being closely adjacent the roller when the cam is in any rotative position in which the cam engages a support strand upon which the bracket is supported.

2. The cable block device of claim 1 in which the main portion of the arm is movable laterally with rotative movement of the cam and in which the main portion of the arm is spaced from the axis of rotation of the rotary shaft.

3. The cable block device of claim 1 in which the cam is provided with a plurality of angularly arranged engagement portions for engaging a strand which supports the bracket.

4. The cable block device of claim 1 in which the cam rotates about the axis of rotation of the shaft and in which the main portion of the arm is attached to the cam at a position spaced from the axis of rotation of the cam.

5. The cable block device of claim 1 in which the retainer portion of the arm is in a plane which is substantially normal to the plane in which the main portion of the arm is located.

6. The cable block of claim 1 in which the retainer portion of the arm is within a plane which is substantially normal to the plane within which the main portion of the arm is located and in which the retainer portion of the arm extends laterally with respect to the main portion of the arm.

7. The cable block device of claim 1 in which the main portion of the arm is at an angle with respect to the axis of rotation of the roller.

8. Cable block apparatus for support by a continuous strand and for support of a cable, in which the apparatus is of the type provided with a bracket for support by the strand and in which a roller is rotatably supported by the bracket, the roller being adapted to support a portion of a continuous cable, and in which a cam is rotatably supported by the bracket and in which the cam is engageable with the strand which supports the bracket to secure the bracket with respect to the strand, the improvement comprising an elongate arm provided with a main portion, means operably joining the main portion of the arm to the cam for angular movement of the arm with rotative movement of the cam, the arm being provided with a retainer portion which is movable between a position spaced from the roller to permit a portion of a cable to be positioned upon the roller and a position closely adjacent the roller as the arm is angularly moved with rotative movement of the cam, the retainer portion preventing escape of a cable from the roller when the retainer portion is closely adjacent the roller.

9. The cable block apparatus of claim 8 in which the retainer portion of the arm is generally normal to the main portion of the arm.

10. The cable block apparatus of claim 8 in which the retainer portion of the arm extends in a plane which is substantially normal to the main portion of the arm so that the retainer portion of the arm is closely adjacent the roller through a significant angular movement of the main portion of the arm.

11. Cable block apparatus for support by a continuous strand and for support of a cable, the apparatus being of the type provided with a bracket for support by the strand, the apparatus also being of the type in which a roller is rotatably supported by the bracket, the roller being adapted to support a portion of a continuous cable, the improvement comprising retainer means movable between a position spaced from the roller for receipt of a cable upon the roller and a position closely adjacent the roller, the retainer means preventing escape of a cable from the roller when the retainer means is closely adjacent the roller, connection means joining the retainer means to the bracket for movement of the retainer means with respect to the bracket, and a cam rotatably supported by the bracket and engageable with the strand which supports the bracket for clamping the bracket to the strand, the connection means including means attaching the retainer means to the cam for movement of the retainer means with rotative movement of the cam.

12. Cable block apparatus for support by a continuous strand and for support of a cable, the apparatus being of the type provided with a bracket for support by the strand and in which a roller is rotatably supported by the bracket, the roller being adapted to support a portion of a continuous cable, the improvement comprising retainer means movable between a position spaced from the roller for receipt of a cable upon the roller and a position closely adjacent the roller, the retainer means preventing escape of a cable from the roller when the retainer means is closely adjacent the roller, connection means joining the retainer means to the bracket for movement of the retainer means with respect to the bracket, and a cam rotatably supported by the bracket and engageable with the strand which supports the bracket for clamping the bracket to the strand, the connection means including a pivotally movable arm, means attaching the arm to the retainer means and to the cam for rotative movement of the cam with pivotal movement of the arm and for movement of the retainer means with pivotal movement of the arm.

13. Cable block apparatus for support by a continuous strand and for support of a cable, the apparatus being of the type provided with a bracket for support by the strand, the apparatus also being of the type in which a roller is rotatably supported by a bracket, the roller being adapted to support a portion of a continuous cable, the improvement comprising retainer means movable to a position spaced from the roller for receipt of a cable upon the roller, the retainer means also being movable to a position closely adjacent the roller, the retainer means preventing escape of a cable from the roller when the retainer means is closely adjacent the roller, connection means joining the retainer means to the bracket for movement of the retainer means with respect to the bracket, and clamping means movably supported by the bracket and engageable with the strand which supports the bracket for clamping the bracket to the strand, the connection means including means attaching the retainer means to the clamping means for movement of the retainer means with movement of the clamping means.

14. The cable block apparatus of claim 13 in which the roller is rotatable about a given axis and in which the retainer means is movable along a path which is generally normal to the axis of rotation of the roller.

15. Cable block apparatus for support by a continuous strand and for support of a portion of a continuous cable, in which the apparatus is of the type provided with a bracket for support by the strand and in which a roller is supported by the bracket and is rotatable about a given axis, the roller being adapted to support a portion of a continuous cable, the improvement comprising:

an elongate arm provided with a main portion which extends angularly from the bracket, means supporting the main portion of the arm upon the bracket for pivotal movement of the main portion of the arm with respect to the bracket, the arm having an elongate retainer portion which is generally at a right angle with respect to the axis of rotation of the roller, the main portion of the arm being pivotally movable to move the retainer portion of the arm between a position spaced from the roller and a position closely adjacent the roller, the retainer portion of the arm when in a spaced position from the roller permitting a cable to be placed upon the roller, the retainer portion of the arm when closely adjacent the roller preventing escape of a cable from the roller, and clamping means carried by the bracket and movable into engagement with the strand which supports the bracket, and connection means joining the clamping means to the main portion of the arm for simultaneous movement of the clamping means and the retainer portion of the arm.

* * * * *